US009427759B2

(12) United States Patent
Chiu

(10) Patent No.: US 9,427,759 B2
(45) Date of Patent: Aug. 30, 2016

(54) LED-ILLUMINATED WATER SPRAYING GUN

(71) Applicant: Shih-Feng Chiu, Changhua (TW)

(72) Inventor: Shih-Feng Chiu, Changhua (TW)

( * ) Notice: Subject to any disclaimer, the term of this patent is extended or adjusted under 35 U.S.C. 154(b) by 14 days.

(21) Appl. No.: 14/570,728

(22) Filed: Dec. 15, 2014

(65) Prior Publication Data

US 2016/0167069 A1 Jun. 16, 2016

(51) Int. Cl.

| | |
|---|---|
| ***B05B 1/26*** | (2006.01) |
| ***B05B 1/30*** | (2006.01) |
| ***B05B 9/01*** | (2006.01) |
| ***B05B 15/00*** | (2006.01) |
| ***F21L 13/06*** | (2006.01) |
| ***B05B 1/12*** | (2006.01) |
| ***B05B 1/16*** | (2006.01) |
| ***F21V 33/00*** | (2006.01) |
| *F21Y 101/02* | (2006.01) |

(52) U.S. Cl.

CPC . *B05B 9/01* (2013.01); *B05B 1/12* (2013.01); *B05B 1/1654* (2013.01); *B05B 15/00* (2013.01); *F21L 13/06* (2013.01); *F21V 33/00* (2013.01); *F21Y 2101/02* (2013.01)

(58) Field of Classification Search

CPC ..... B05B 1/12; B05B 1/1645; B05B 1/1654; B05B 9/01; B05B 15/00; F21L 13/06; F21V 33/00; F21Y 2101/02

USPC ..... 239/289, 390–392, 394, 525, 526, 239/587.1, 587.5, 587.6; 362/192, 253

See application file for complete search history.

(56) References Cited

U.S. PATENT DOCUMENTS

| | | | | |
|---|---|---|---|---|
| 4,564,889 | A * | 1/1986 | Bolson | F21S 8/00 290/54 |
| 4,616,298 | A * | 10/1986 | Bolson | A62C 37/08 290/54 |
| 6,286,767 | B1 * | 9/2001 | Hui-Chen | B05B 1/1654 239/392 |
| 6,540,159 | B1 * | 4/2003 | Wang | B05B 15/066 239/525 |
| 6,540,163 | B1 * | 4/2003 | Huang | B05B 15/066 239/280.5 |
| 7,607,789 | B2 * | 10/2009 | Lu | F21V 33/004 239/18 |
| 2003/0147238 | A1 * | 8/2003 | Allen | F03B 13/00 362/192 |
| 2005/0001070 | A1 * | 1/2005 | Wu | B05B 1/3013 239/526 |
| 2005/0237742 | A1 * | 10/2005 | Wang | B05B 15/00 362/253 |
| 2008/0225517 | A1 * | 9/2008 | Clark | B05B 1/185 362/192 |
| 2009/0247043 | A1 * | 10/2009 | Liao | B05B 15/00 446/405 |
| 2012/0298778 | A1 * | 11/2012 | Chen | B05B 9/01 239/394 |

* cited by examiner

*Primary Examiner* — Darren W Gorman

(74) *Attorney, Agent, or Firm* — Che-Yang Chen; Law Offices of Scott Warmuth

(57) ABSTRACT

A LED-illuminated water spraying gun may include a spray gun, a cover body, a base, a LED light, a diversion piece, and a water cover. The base has a first chamber and a second chamber, and a through hole is formed between the first chamber and the second chamber, and the power generator of the LED light can be disposed inside the first chamber and a shaft of the power generator is protruding into the second chamber. A plurality rotating blades are connected to the shaft, and by rotating the blade with water flow, the power generator can further power the LED light. A diversion hole that is outside of first chamber of the base is connected to the second chamber and the water cover covers the base of the cover body. By rotating the water cover, different types of water spraying holes can be selected.

9 Claims, 11 Drawing Sheets

LED-ILLUMINATED WATER SPRAYING GUN

FIELD OF THE INVENTION

The present invention relates to a spray gun structure, especially one with LED light, and the availability to change its water outflow spray function.

BACKGROUND OF THE INVENTION

Referring to FIGS. 11 and 12 for the conventional spray gun structure, the spray gun 80 has a spray gun body 81. The spray gun body 81 in the lateral outlet conduit 82 has an open-ended semi-circular hood 83. In front of a mesh ring 831, water flows out from the semi-circular hood 83. Also, inside the semi-circular hood 83, there is an illumination device 84 and an interconnected power system 85. The bottom of the axial of the semi-circular hood 83 formed a tube chamber 832. There are couple through holes 833 reserved between outside of the tube chamber 832, and inner edge of the bottom axial. Water flow can be guided through the holes 833 into the hood 83. There is an outer cover 834 locked at the front portion of the hood 83. The illumination device 84 is also set at the front portion of the hood 83. This includes a base 842 of a lighting piece 841. The two connected onto the guide wire 843 of the lighting piece 841. One set to the light extension cover 844 of the lighting piece 841 and light cover 845. The light cover 845 is interlocking with the base 842. The power system 85 that is installed in the tube chamber 832 included a generator 851. One end of the generator 851 installed a circuit board 852 to provide the connections of two guide wires 853. The other end of the generator 851 tied to a drive shaft 854 protruding at the bottom of the tube chamber 832. A blade disc 86 is connected to the drive shaft 854. There are a number of curved fan blades 861 to the ring edge near the plate body of the blade disc 86. Also, there is an inlet plate 87 covered on the blade disc 86. The inlet plate 87 has a plurality of outlet holes 871. The outlet holes 871 are to be aligned to fan blade 861 of the blade disc 86. When water flow is derived from the outlet holes 871, it is to be guided towards the fan blade 861 of the blade disc 86 from the power system 85. Trigger the electric power generated by the rotation of the blade disc 86 used as the power source of the illumination device 84. Water outflow from open end portion of the fan blade 861, and introduced into hood 83 via the through holes 833, then export from mesh ring 831 formed as water spraying effects.

It is not difficult to find some of the remaining shortages from the above mentioned conventional structure, mainly due to the following reasons: (1) the conventional spray gun 80 has an illumination device 84 and an interconnected power system 85, without any choice for water spray mode adjustment. The function is way too simple, so that the lack of usability becomes one of its deficiencies; (2) the conventional spray gun 80 cannot be quickly removed into parts, and the blade disc 86 is likely to be stuck with water stain and cannot be cleaned, repaired or replaced, resulting in low durability; (3) water flow from the conventional spray gun 80 direct impacts the blade disc 86 from the outlet hole 871 of the outlet plate 87. The flow direction is not toward the front of the fan blades 861, resulting in the flow momentum dispersion offset, which cannot effectively drive fan disc 80 to rotate, and causing poor stability for the power generator 851, and the lighting piece 841 flashes easily; and (4) the conventional spray gun does not include the water outflow spray adjustment function.

Therefore, there remains a need for a new and improved design of a water spraying gun to overcome the problems stated above.

SUMMARY OF THE INVENTION

The present invention is to address the above-mentioned problems in conventional spray guns by providing a LED light spray gun structure.

A grip handle is formed onto the spray gun, and a press button is set on the grip handle. On one end of the grip handle, it is coupled to a rotor and a joint clutch is connected. The central of the joint clutch has an outlet water hole. The press button can control the water spray status. Two blanks convex set at the outer edge of the joint clutch. A horn sharped cover is formed with two of the interlinked large diameter portion and small diameter portion. A joint pipe combined with the small diameter portion, so that the cover can be set with its joint pipe connected to the joint clutch of the spray gun. The inner edge of the joint pipe is provided with two protruding stoppers. The stoppers and a dodge piece set with its joint pipe onto the joint clutch. Then, rotate the joint pipe to form an overlapping position with the stopper and the dodge piece. With this quick connection function, the water spraying gun can be operated more easily by the user.

A base at one end formed with a first chamber, and the other end formed with a second chamber. A through hole is formed between the first chamber and the second chamber. The base located inside the cover body. It is interlinked with an outlet water hole, which is fixed to the small-diameter portion by the first chamber. A guide hole, which can be interlinked with the first chamber, is set outside of second chamber of the base. At the end of the guide hole, a piece of washer is installed. The washer is to be used as the purpose of sealing water outflow with the water cover. A down hook portion is set at convex outer edge to the opening of the first chamber.

The power supply of a LED light is connected with a power generator. A shaft is extended through the power generator. The LED light to the power generator is set into the second chamber of the base. So the shaft can pass the through hole and be projected out into the first chamber. A set of rotating blades is connected to the shaft at the first chamber, as shown in FIG. 7. A magnet rotor is formed inside of power generator connected to the shaft. The outer edge of magnet rotor tied a plurality of stator coils.

A diversion piece formed around a ring wall. The ring wall coupled to the base of the first chamber further covered a rotating blade. The diversion piece around the middle of the ring wall projected a plurality of convex portions. A rotation hole is opened as the oblique position in the convex portions. A water outlet is located on the ring wall of the diversion piece. The rotation hole and diversion hole can interflow with the water outlet. Furthermore, the diversion piece formed around the ring wall, has a gap opening. A positioning column is set at the inner edge of the joint pipe in the convex position. The positioning column is to be interposed to a guide notch of the diversion piece. To further position the diversion piece and the opposite location of the joint pipe. The positioning column through the formation of the barrier flap, to control the joint clutch and the joint pipe buckle location.

A water cover has a central hole opened at the center of the cover. A lampshade is connected in the center hole. The outlet cover formed a plurality of spray holes in the outer ring at the central hole. The water cover covered the cover of the large diameter portion. The down hook portion of the base formed the fixed cover. The LED light can be drilled in the shade position, further connecting the spray holes with the diversion hole of the base. A stopper hole is set to the base on the other side of the second chamber. The stopper hole is set with a spring and a top block in sequence. The extra potation of the spring is pressed against the top block to the outlet cover.

The rotor has a fixed plate, a movable plate and a side cover. The fixed plate integrally formed on the grip handle of the spray gun. The fixed plate is corresponding to a first surface and a second surface. The movable plate can spin and coupled to the first surface. The side-cover covers onto the second surface of the fixed plate.

The joint clutch is fixed to the movable plate. A through hole is located in the central opening of the fixed plate. The outlet hole of the joint clutch is passed with the through hole. A sealing ring is provided between the fixed plate and the movable plate.

A hole is opened at the second surface of the fixed plate. A screw wears through the hole. The screw is provided to lock the moveable plate, so that a connection is formed by rotating between the fixed disk and the moveable plate.

A fixed plate has a plurality of concave grooves at the first surface. The activity disc opened with a slot. A spring and a block are set by the slot in sequence. The top block conflict is formed the fixed plate and a movable plate in the groove of the rotational position.

The first objective of the present invention is that, a base at one end formed with a first chamber, and the other end formed with a second chamber. A through hole is formed between the first chamber and the second chamber, so that the power generator of the LED light can be set inside of the first chamber. A magnet rotor is formed inside of power generator connected to the shaft reach the second chamber. The outer edge of magnet rotor tied a plurality of stator coils. By rotating the blade of the magnet rotor to further generate power up this LED light.

The diversion hole that is outside of first chamber of the base is connected. The outlet cover covered to the base of the cover body. By rotating the outlet cover, choices of selection to variety of spray holes point to the diversion hole 34 of the base. The action does not affect the usage of the LED light. Furthermore, it provides the LED light system and also available for users to change water spray functions.

The second objective of the present invention is that, on one end of the spray gun, a joint clutch is connected. There are two blanks convex set at the outer edge, and two stoppers formed at the inner edge of the joint clutch. The stoppers and a dodge piece set with its joint pipe onto the joint clutch. Then, rotate the joint pipe to form an overlapping position with the stoppers and the dodge piece. The joint pipe can be limited and unable to release the spray gun. With this quick connecting function, it is easy for the user to replace or repair.

The third objective of the present invention is that, the diversion piece around the middle of the ring wall projected a plurality of convex portions. A rotation hole is opened as the oblique position in the convex portions. With the flow guide of the convex portion, because the rotation hole is in oblique position, and being pushed with groove guide, the direct impacts of the water flow directly flush the front of the rotary vane, further increasing the pressure to the rotating blades. As the rotational speed and the torque of the rotary blade increases, the stability of the power generation gets more stable.

The fourth objective of the present invention is that, the rotor has a fixed plate, a movable plate. The moveable plate is pivoted to the hole of the fixed plate by a screw, so that the through hole of the fixed plate can be connected to the movable plate to the outlet hole of the joint clutch. The movable disk can spin emphasis on the screw as the center of rotation with more and further changes to joint clutch of spray gun relative angle to adjust the water spraying elevation.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

Figure 1:
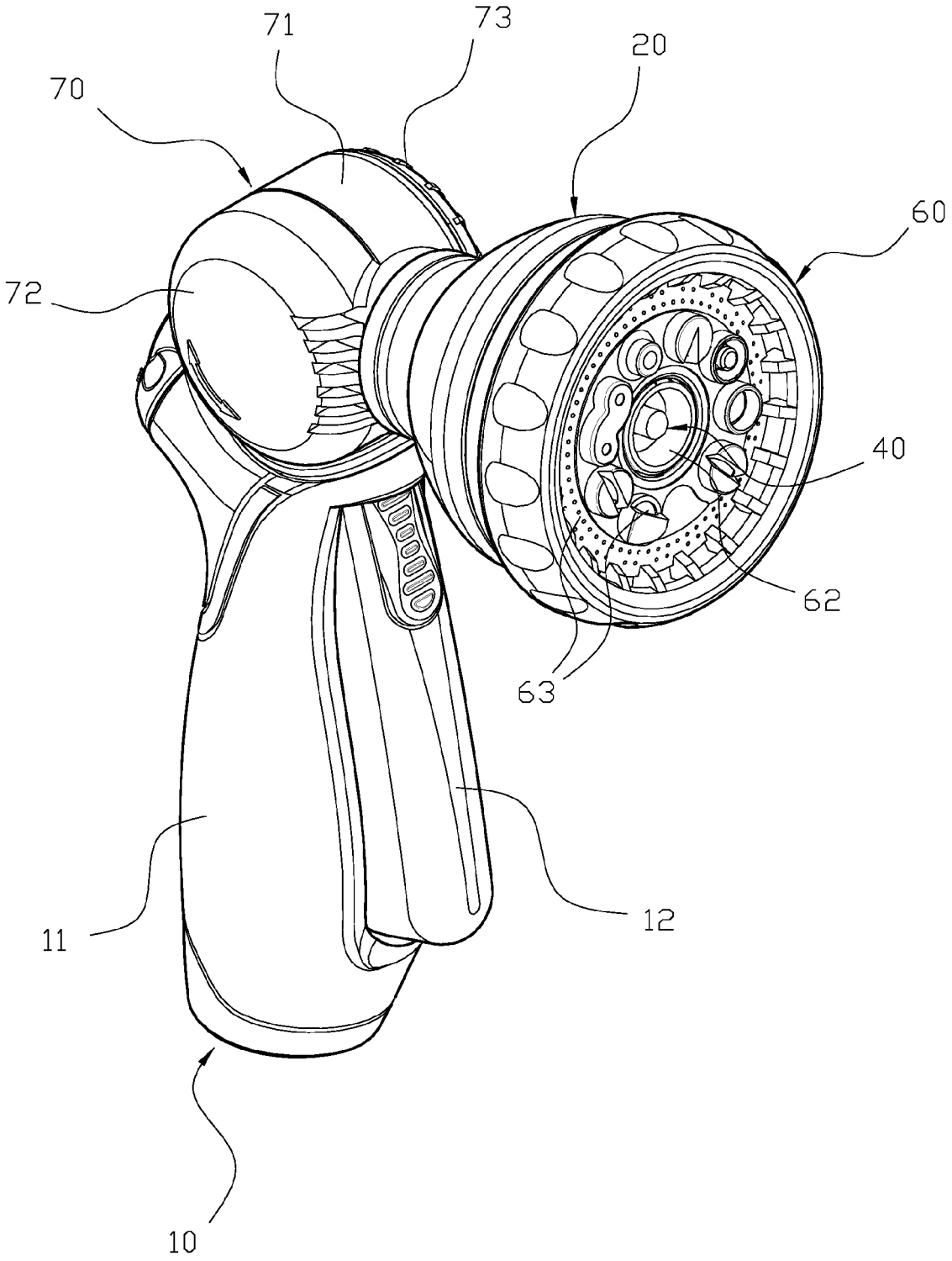
FIG. 1 illustrates a three-dimensional view of the water spraying gun in the present invention.
Figure 2:
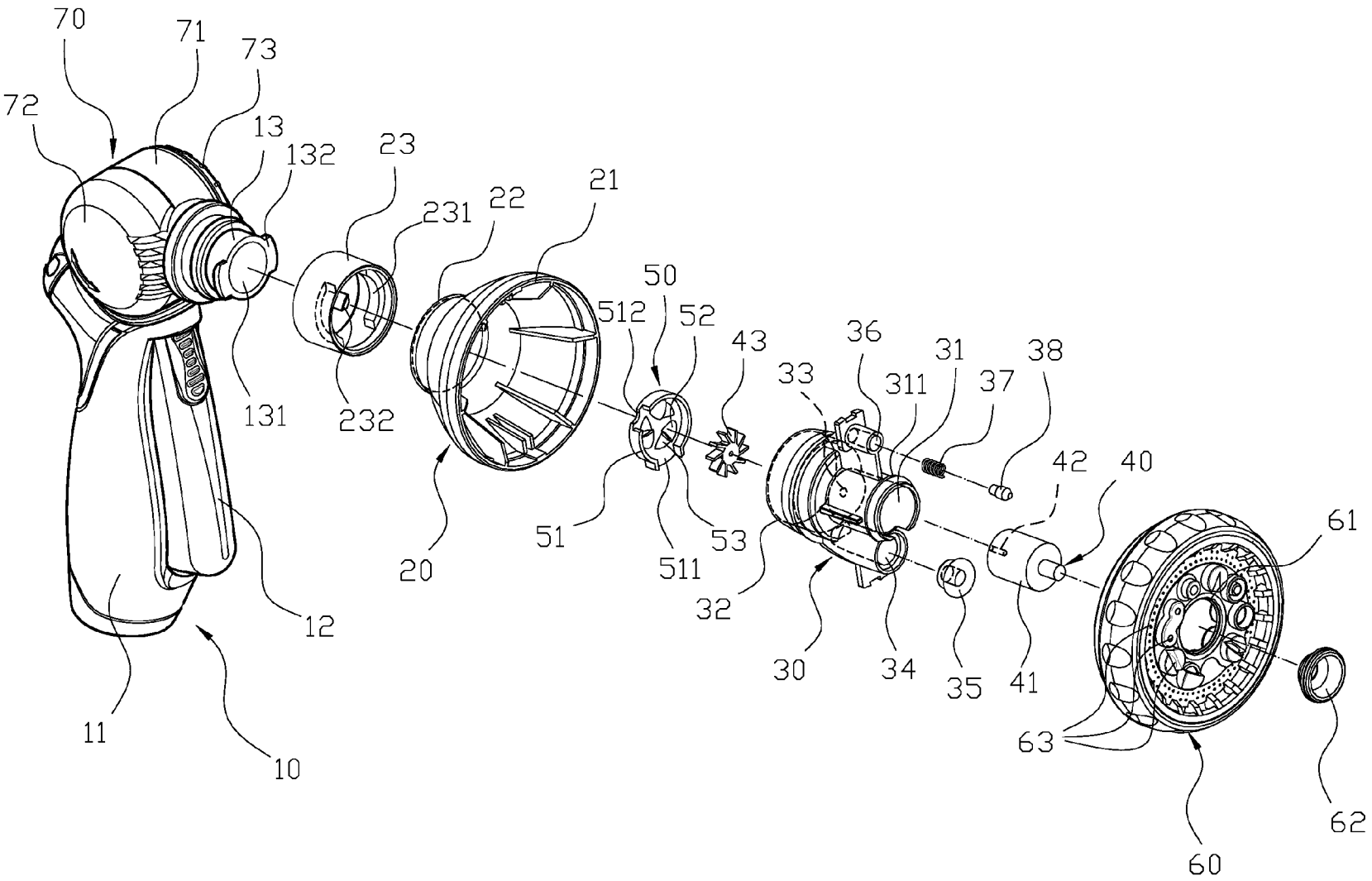
FIG. 2 illustrates an exploded view of the water spraying gun in the present invention.
Figure 3:
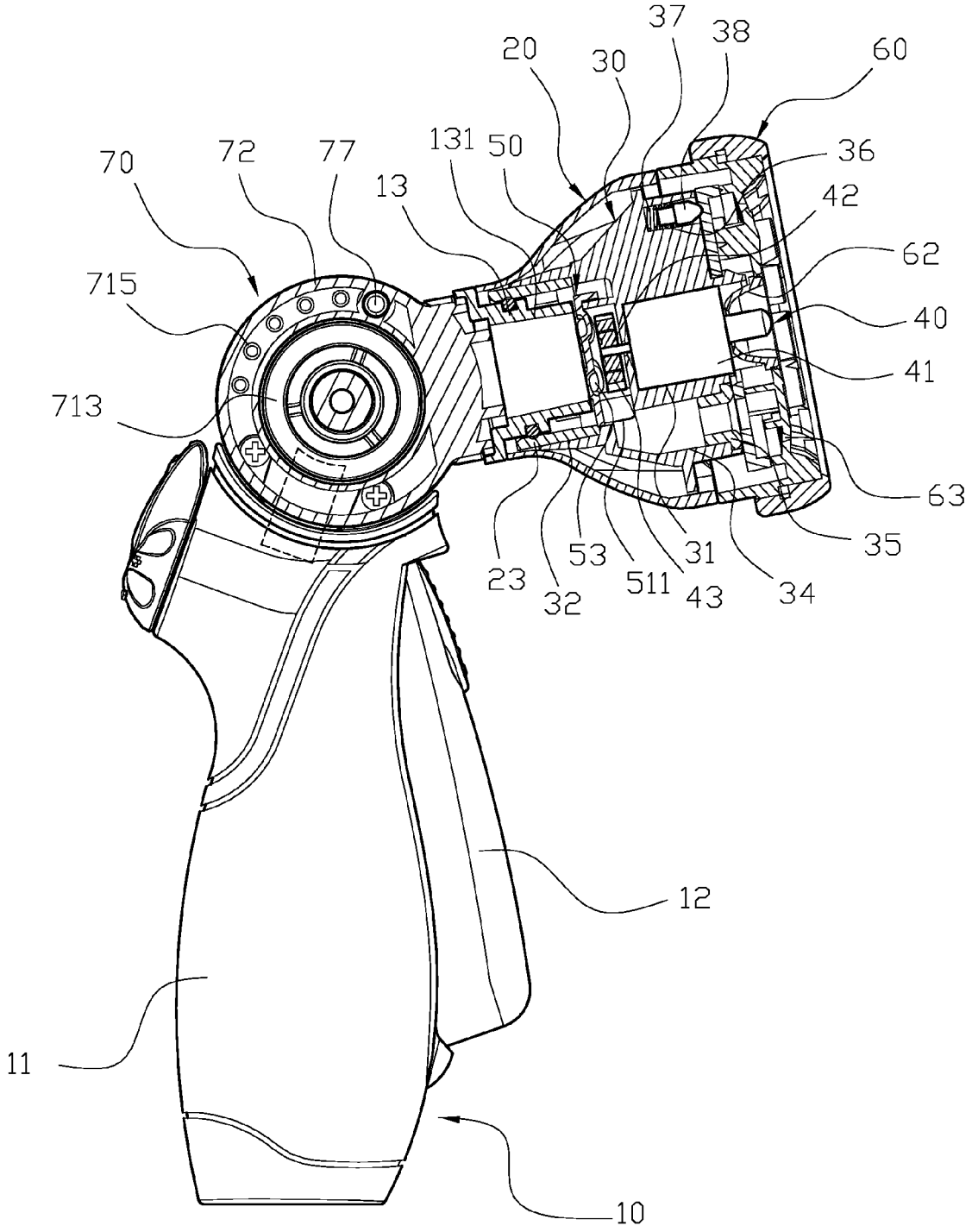
FIG. 3 illustrates a sectional view of the water spraying gun in the present invention
Figure 4:
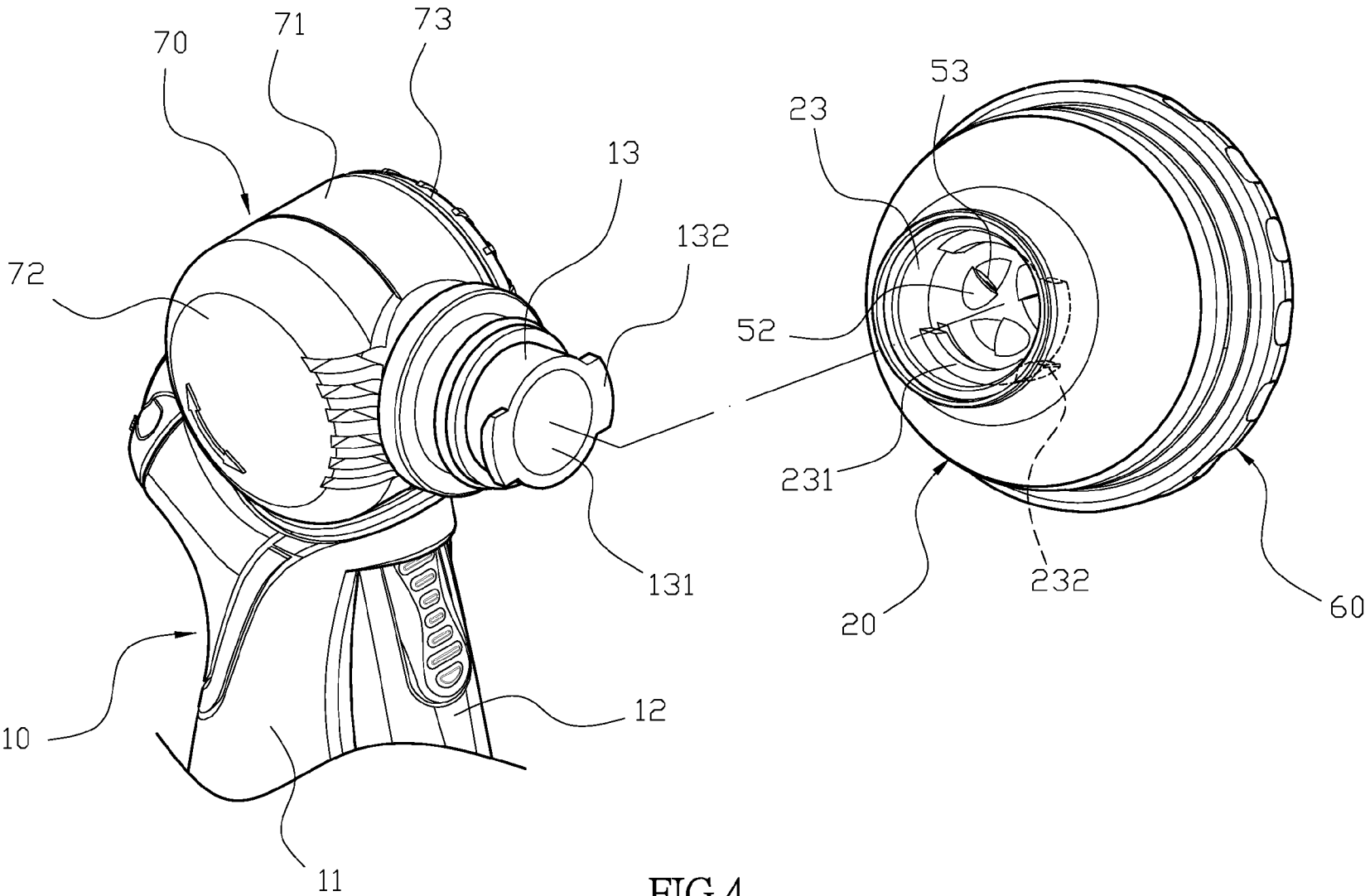
FIG. 4 illustrates a schematic view of the connection of the joint clutch and joint pipe in the present invention.
Figure 6:
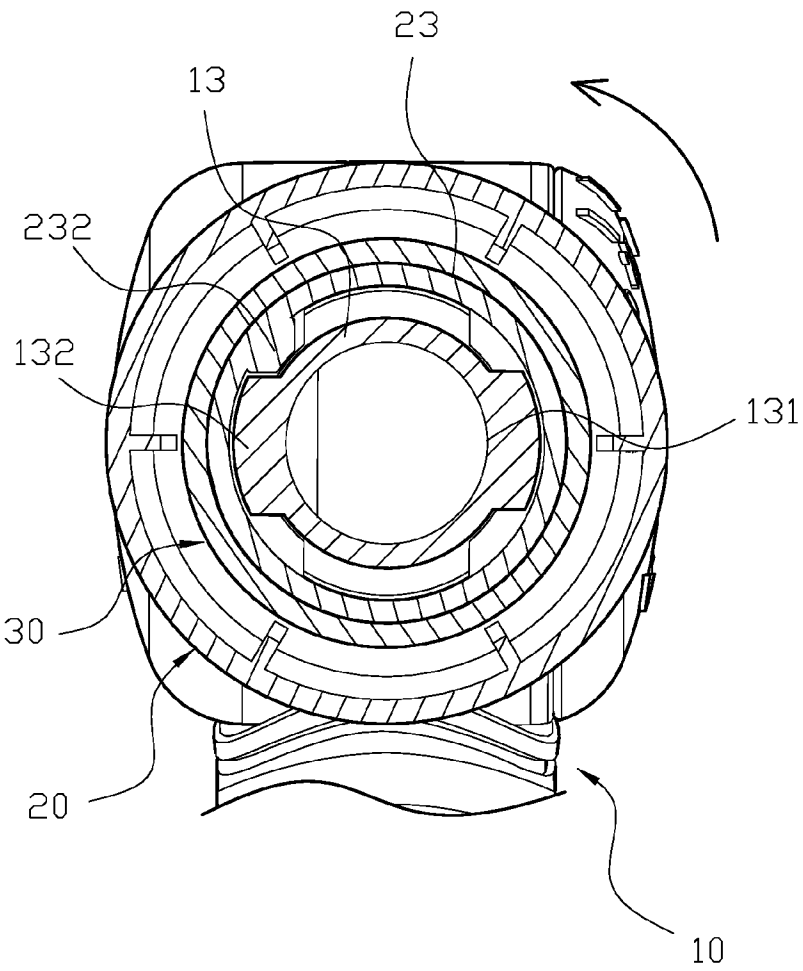
FIG. 6 a second sectional view of the connection of the joint clutch and joint pipe in the present invention.
Figure 5:
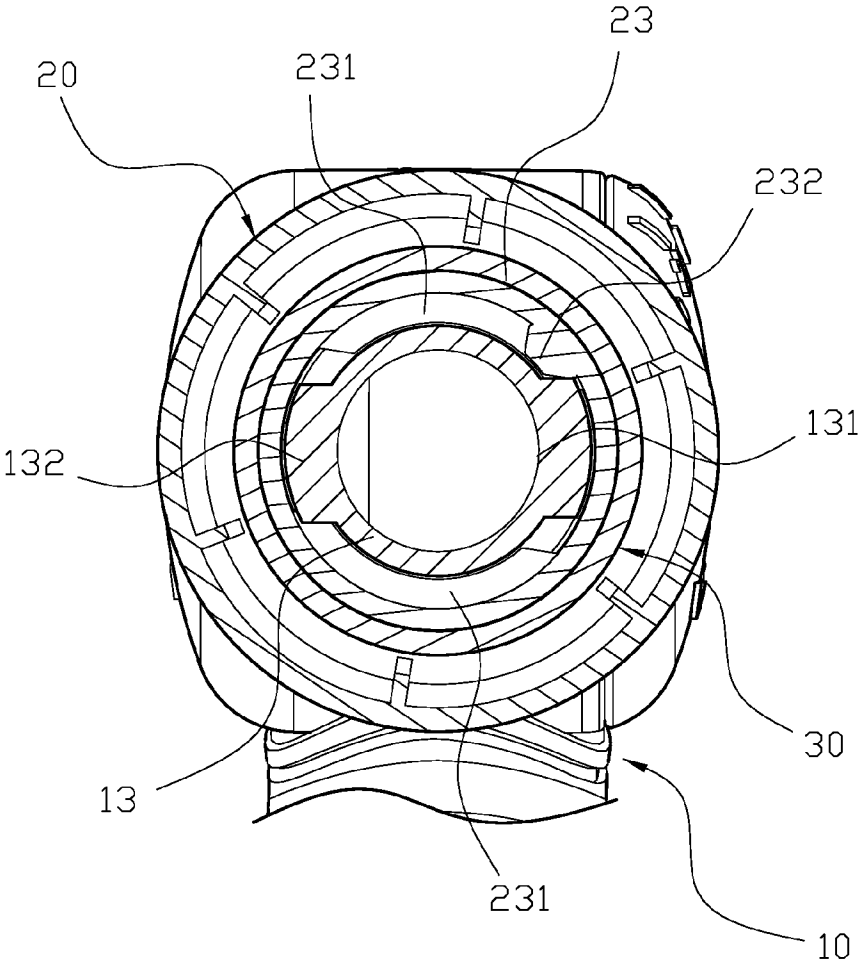
FIG. 5 illustrates a first sectional view of the connection of the joint clutch and joint pipe in the present invention.

In order to further understand the goal, characteristics and effect of the present invention, a number of embodiments along with the drawings are illustrated as following:

Referring to FIGS. 1 to 3, an LED-illuminated water spraying gun may include a spray gun 10, a cover body 20, a base 30, a LED light 40, a diversion piece 50, and an water cover 60. A grip handle 11 is formed onto the spray gun 10, and a press button 12 is set on the grip handle 11. On one end of the grip handle 11, it is coupled to a rotor 70 and a joint clutch 13 is connected. The central of the joint clutch 13 has an outlet water hole 131. The press button 12 can control the water spray status. There are two blank dodge pieces 132 at the outer edge of the joint clutch 13. A horn sharped cover body 20 is formed with two of the interlinked large diameter portion 21 and small diameter portion 22. A joint pipe 23 combined with the small diameter portion 22. So that the cover body 20 can be set with its joint pipe 23 connected to the joint clutch 13 of the spray gun 10, please refer to FIGS. 4, 5, and 6. The inner edge of the joint pipe 23 is provided with two protruding stoppers 231. The stoppers 231 and a dodge piece 132 set with its joint pipe 23 onto the joint clutch 13. Then, rotate the joint pipe 23 to form an overlapping position with the stoppers 231 and the dodge piece 132. With this quick connection function, the water spraying gun in the present invention become much easier to use.

A base 30 at one end formed with a first chamber 31, and the other end formed with a second chamber 32. A through hole 33 is formed between the first chamber 31 and the second chamber 32. The base 30 located inside the cover body 20. It is interlinked with an outlet water hole 131, which is fixed to the small-diameter portion 22 by the first chamber 31. A diversion hole 34, which can be interlinked with the first chamber 31, is set outside of second chamber 32 of the base 30. At the end of the diversion hole 34, a piece of washer 35 is installed. The washer 35 is to be used as the purpose of sealing water outflow with the water cover 60. A down hook portion 311 is set at convex outer edge to the opening of the first chamber 31.

Figure 7:
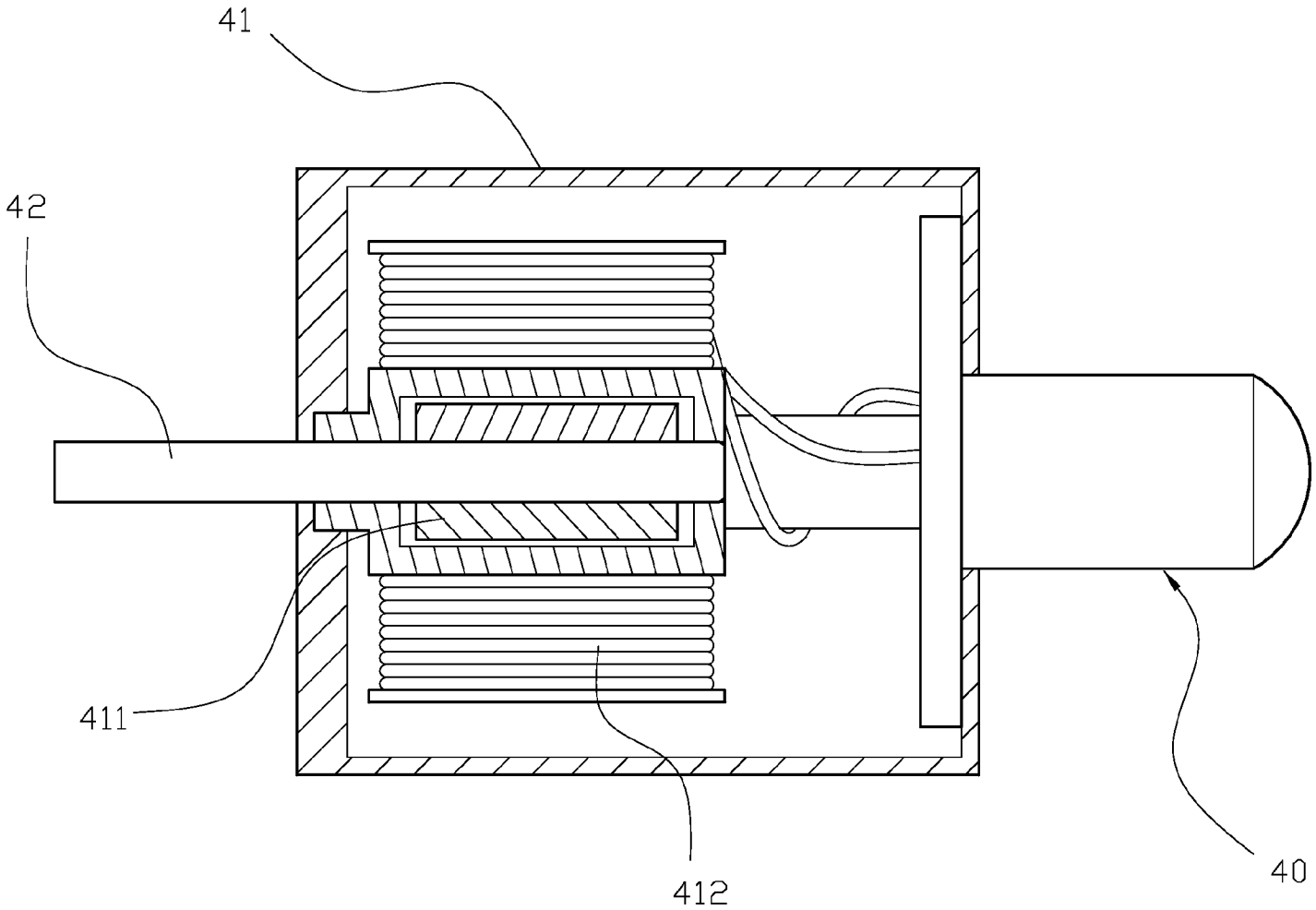
FIG. 7 illustrates a sectional view of the LED light and power generator in the present invention.

The power supply of a LED light 40 is connected with a power generator 41. A shaft 42 is extended through the power generator 41. The LED light 40 to the power generator 41 is set into the second chamber 32 of the base 30. So the shaft 42 can pass the through hole 33 and be projected out into the first chamber 31. A set of rotating blades 43 is connected to the shaft 42 at the first chamber 31, as shown in FIG. 7. A magnet rotor 411 is formed inside of power generator 41 connected to the shaft 42. The outer edge of magnet rotor 411 tied a plurality of stator coils 412. By rotating the blades 43 of the magnet rotor 411 with its relative rotation, the stator coils 412 formed a magnetic cutting line, to further generate power to light up this LED light 40.

A diversion piece 50 formed around a ring wall 51. The ring wall 51 coupled to the first chamber 31 of the base 30, further covered a rotating blades 43. The diversion piece 50 around the middle of the ring wall 51 projected a plurality of convex portions 52. A rotation hole 53 is opened as the oblique position in the convex portions 52. A water outlet 511 is located on the ring wall 51 of the diversion piece 50. The rotation hole 53 and diversion hole 34 can interflow with the water outlet 511. Furthermore, the diversion piece 50 formed around the ring wall 51, has a slot 512. A positioning column 232 is set at the inner edge of the joint pipe 23 in the convex position. The positioning column 232 is to be interposed to a slot 512 of the diversion piece 50. To further position the diversion piece 50 and the opposite location of the joint pipe 23. The positioning column 232 through the formation of the dodge piece 132, to control the joint clutch 13 and the joint pipe 23 buckle location.

A water cover 60 has a central hole 61 opened at the central. A light cover 62 is connected in the central hole 61. The water cover 60 formed a plurality of spray holes 63 in the outer ring at the central hole 61. The water cover 60 covered the cover body 20 of the large diameter portion 21. The down hook portion 311 of the base 30 formed the fixed water cover 60. The LED light 40 can be drilled in the light cover 62 position. Further connecting the spray holes 63 with the diversion hole 34 of the base 30. A stopper hole 36 is set to the base 30 on the other side of the second chamber 32. The stopper hole 36 is set with a spring 37 and a top block 38 in sequence. The extra potation of the spring 37 is pressed against the top block 38 to the water cover 60. A water diversion hole 34 of the water cover 60 is interlinking the spray holes 63 to form the effects with different positioning effect.

Referring to FIGS. 1 to 4, the shaft 42 of the LED light 40 is disposed into the first chamber 31 within the base 30, so that the shaft 42 can penetrate the perforations 33 of the base 30. The rotating blades 43 are to be assembled onto the projections provided in the second chamber 32 of the on the shaft 42. Furthermore, the diversion piece 50 is to be set into the ring wall 51 at the base 30 of the second chamber 32. The diversion piece 50 can cover the rotating blades 43. With the diversion hole 34 of the base 30 connecting to water outlet 511 of the diversion piece 50. The second chamber 32 of the base 30 connected the joint pipe 23. As the positioning column 232 of the joint pipe 23 inserted in the slot 512 of the diversion piece 50, the joint pipe 23, the diversion piece 50 and the base 30 are positioned relatively.

The small diameter portion 22 of the cover body 20 is connected with the joint tube 23. The cover body 20 can be set outside of the base 30. Also, a spring 37 and a block piece 38 set up in the block hole 36 of the base 30 in sequent. The diversion hole 34 set a washer 35. The water cover is set at the large diameter portion of the cover body 20, so that the down hook portion 311 of the base 30 can set the outlet water cover 60. Further, a positioning water cover 60 is formed, so that the rotation itself can be controlled. A light cover 62 is set in the central hole 61 of the water cover 60. The LED light 40 can wear through light cover 62. Finally, combine the assembled cover body 20, base 30, LED light 40, diversion piece 50, and water cover 60 into one complete piece. The joint tube 23 has being set to interlock the joint clutch 13 of the spray gun 10. The block piece 132 of the joint clutch 13 and the block piece 231 of the joint tube 23 using a suitable angel to avoid each other, so that the joint tube 23 is easily interlocking each other, further, to limit the joint tube 23 not to move away the spray gun 10, and further reach the spray gun 10 quick restructure function.

Figure 8:
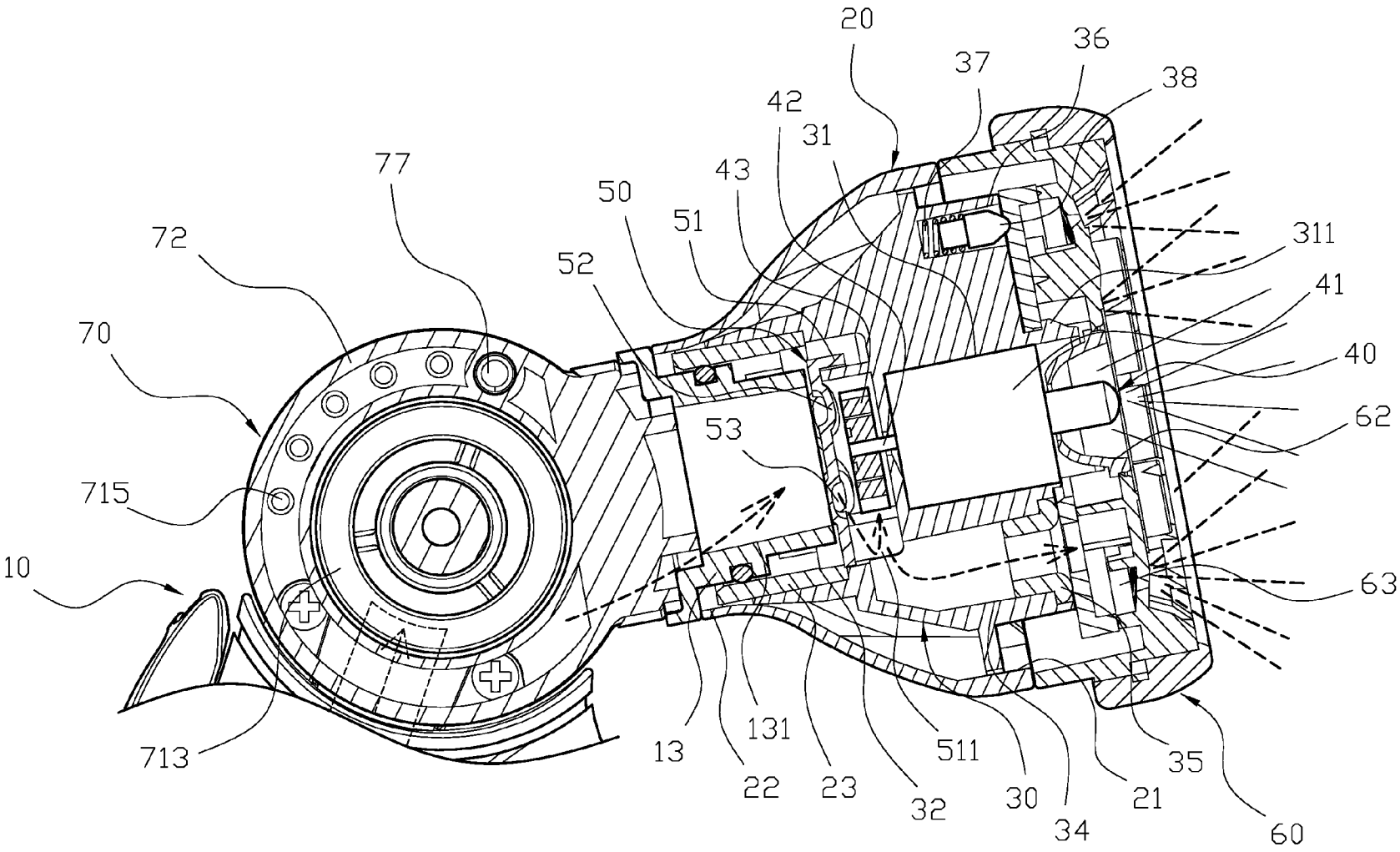
FIG. 8 illustrates a schematic view of the present invention in use.

When in use, referring to FIGS. 2, 7 and 8, the spray gun 10 can control the open and close of the water outflow by using press button, so that the water flow can outflow through rotor 70 through the outlet water hole 131 of the joint clutch 13. Also, by using the outlet water hole 131, the water flow into the second chamber 32 of the base 30. Further, flowing through the rotation hole 53 of the diversion piece 50, and flow pass water outlet 511 of the diversion piece 50 and outflow from diversion hole 34 of the base 30. The spray holes 63 selection makes water spray differently. The water cover 60 can rotate based on the central location of the LED light 40. The diversion hole 34 has different outlet spray holes 63 to reach variety water spray mode choices. When choosing the water spray mode, the spring 37 can push the block piece 38 towards the water cover 60 for the base 30.

With this positioning status to choose the water cover 60, here is to explain further. With the flow guide of the diversion piece 50, because the rotation hole 53 is in oblique position, and being pushed with groove guide, the direct impacts of the water flow directly flush the front of the rotating blades 43, further increasing the pressure to the rotating blades 43. As the rotational speed and the torque of the rotating blades 43 increases, the stability of the power generation 41 gets more stable. At the same time, a magnet rotor 411 is formed inside of power generator 41 connected to the shaft 42. The outer edge of magnet rotor 411 tied a plurality of stator coils 412, further generate the stator coils 412 power, and directly provide LED light 40 enough electric power. By utilizing the above structure, the present invention is able to change water spray function, without interfering the LED light usage. Therefore, the LED light 40 have both lighting, and interchanging the spray mode dual functions.

Figure 9:
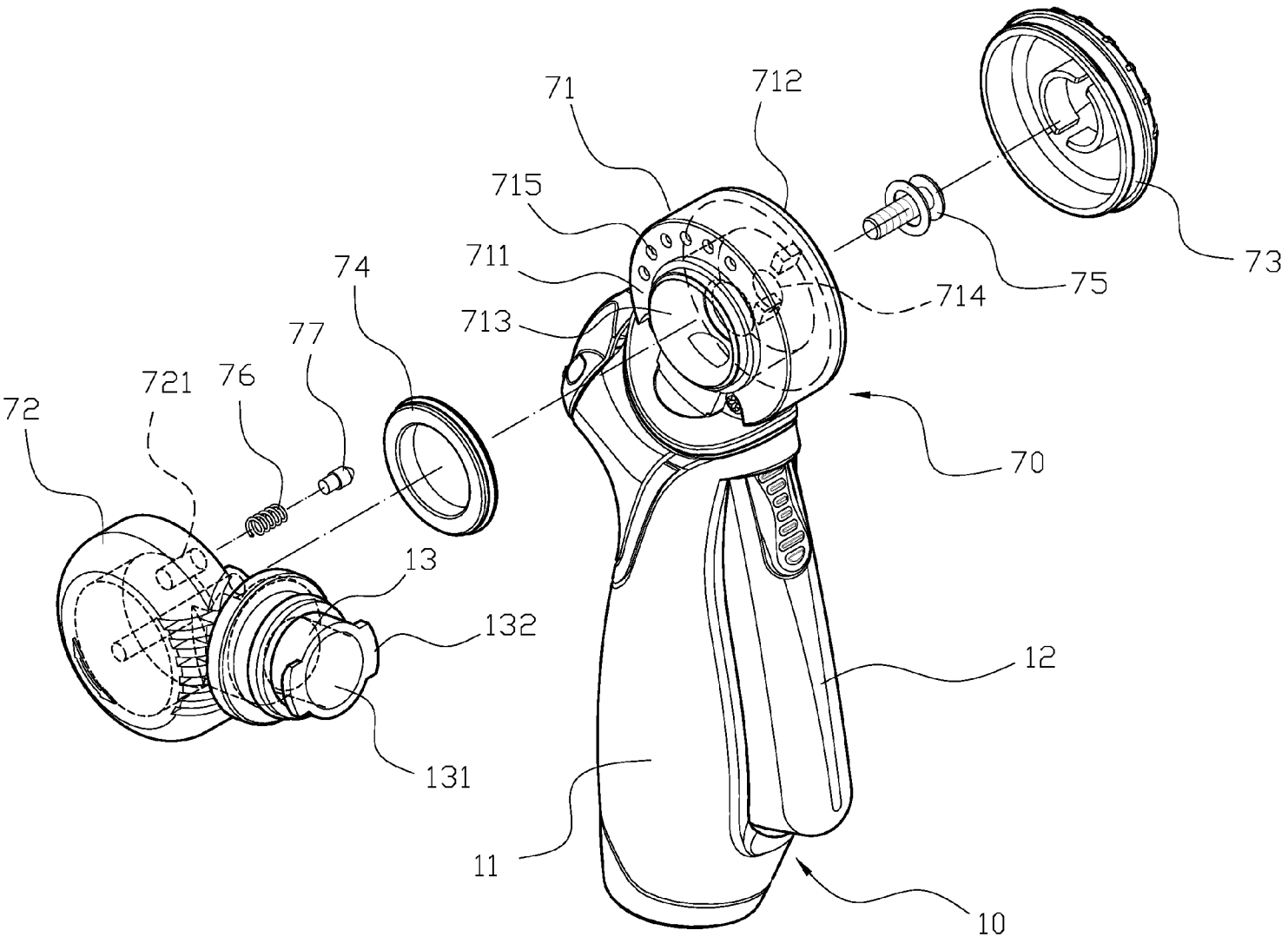
FIG. 9 is an exploded view of the rotor in the present invention.
Figure 10:
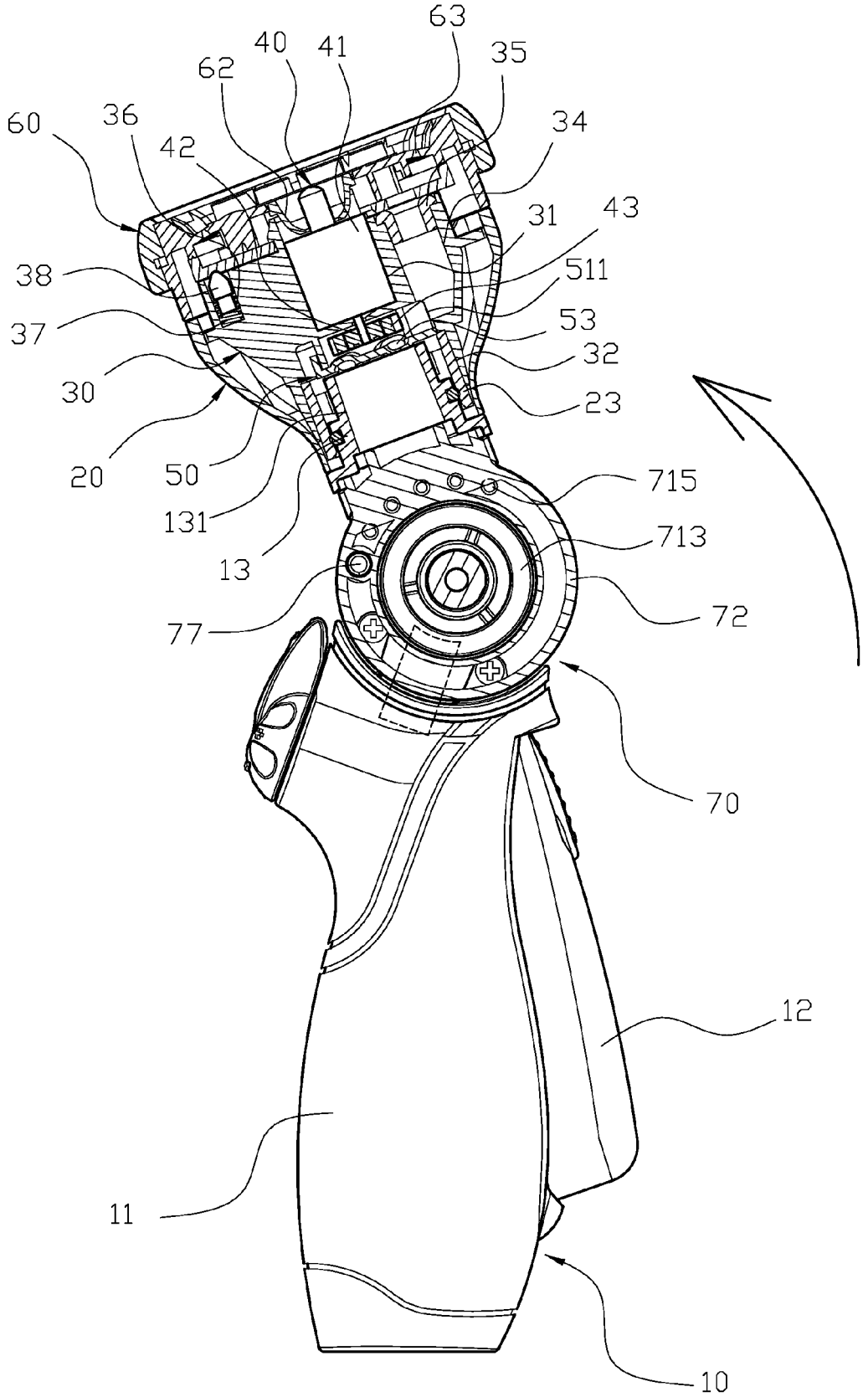
FIG. 10 is a schematic view of the rotator in action in the present invention.
Figure 11:
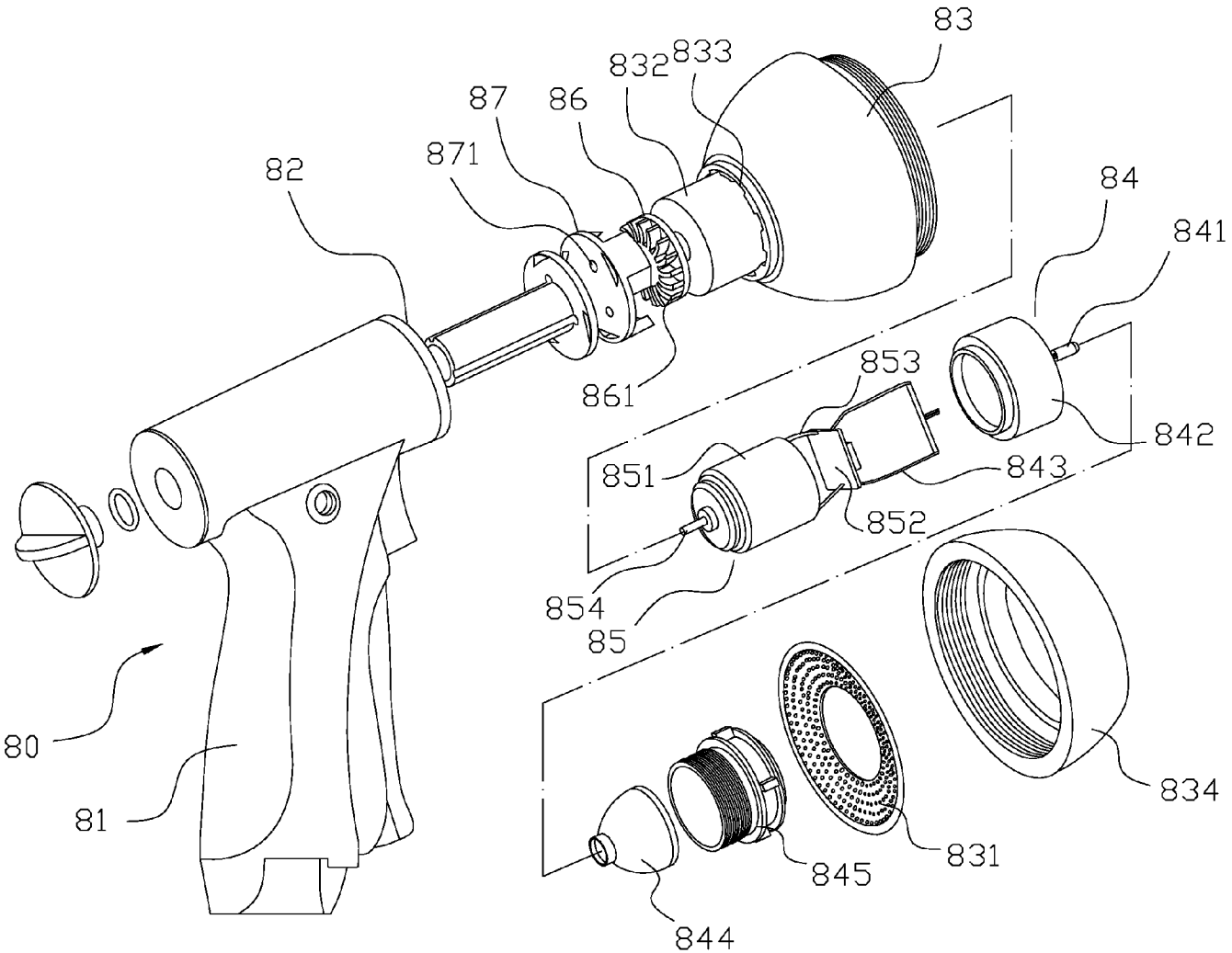
FIG.11 PRIOR ART
FIG. 11 is an exploded view of a prior art.
Figure 12:
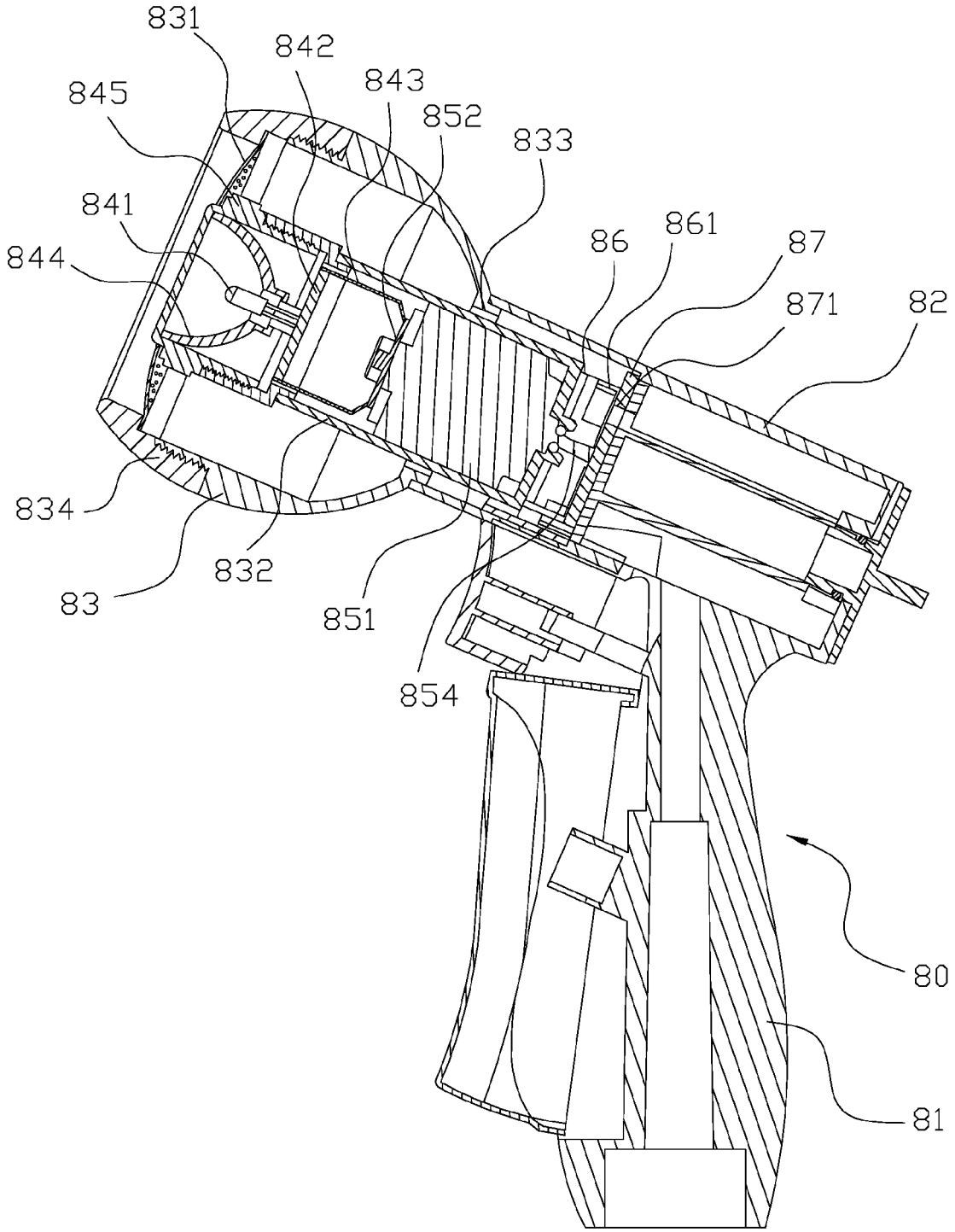
FIG.12 PRIOR ART
FIG. 12 is a sectional view of the prior art.

"Referring to FIGS. 9 and 10, the rotor 70 has a fixed plate 71, a movable plate 72 and a side-cover 73. The fixed plate 71 integrally formed on the grip handle 11 of the spray gun 10. The fixed plate 71 is corresponding to a first surface 711 and a second surface 712. The movable plate 72 can spin and coupled to the first surface 711. The side-cover 73 covers onto the second surface 712 of the fixed plate 71. The joint clutch 13 is fixed to the movable plate 72. A through hole 713 is located in the central opening of the fixed plate 71. The outlet water hole 131 of the joint clutch 13 is passed with the through hole 713. A sealing ring 74 is provided between the fixed plate 71 and the movable plate 72. This is to form the leak-proof effect between the fixed plate 71 and the moveable plate 72. A hole 714 is opened at the second surface of the fixed plate 71. A screw 75 wear through the hole 714. The screw 75 is provided to lock the moveable plate 72, so that a connection is formed by rotating between the fixed plate 71 and the moveable plate 72. A fixed plate 71 has a plurality of recessed grooves 715 at the first surface 711. The activity disc 72 opened with a slot 721. A spring 76 and a block 77 are set by the slot 721 in sequence. The top block 77 conflicts a recessed grooves 715 formed the fixed plate 71 and a movable plate 72 to rotate its position. As described above, the moveable plate 72 is pivoted to the hole 714 of the fixed plate 71 by a screw 75. So that the through hole 713 of the fixed plate 71 can be connected to the movable plate 72 to the outlet water hole 131 of the joint clutch 13. The movable plate 72 can spin emphasis on the screw 75 as the center of rotation with more and further changes to joint clutch 13 of spray gun 10 relative angle to adjust the water spraying elevation."

Comparing with conventional water spraying guns, the present invention is advantageous because the base 30 at one end formed a first chamber 31, and the other end formed a second chamber 32. The through hole 33 is formed between the first chamber 31 and the second chamber 32, interlinked with each other. The power supply of a LED light 40 is connected with a power generator 41 inside the first chamber 31. The shaft 42 is extended through the power generator 41 into the second chamber 32. A set of rotating blades 43 is connected to the shaft 42. By rotating the blades 43 with water flow, the power generator 41 can further generate power to light up this LED light 40. The water cover 60 covered to the base 30 of the cover body 20. By rotating the water cover 60, choices of selection to variety of spray holes 63 point to the diversion hole 34 of the base 30. The action does not affect the usage of the LED light 40. Furthermore, it provides the LED light 40 system and also available for users to change water spray functions, and increase its easy usage.

Also, on one end of the spray gun, a joint clutch 13 is connected; also, there are two dodge pieces 132 set at the outer edge of the joint clutch 13. A diversion piece 50 formed around the middle of the ring wall 51 projected a plurality of convex portions 52. A rotation hole 53 is opened as the oblique position in the convex portions 52. The inner edge of the joint pipe 23 is provided with two protruding stoppers 231. The stoppers 231 and a dodge piece 132 set with its joint pipe 23 onto the joint clutch 13. Then, rotate the joint pipe 23 to form an overlapping position with the stopper 231 and the dodge piece 132. With this quick connection function to increase its easy usage features, so that the spray gun 10 is available for fast replacement or repair functions. When water flow with the rotation hole 53 through the diversion piece 50, the rotation hole 53 is opened as the oblique position in the convex portions. With the flow guide of the convex portion 52, the direct impacts of the water flow directly flush the front of the rotating blades 43, further increasing the pressure to the rotating blades 43. As the rotational speed and the torque of the rotating blades 43 increases, the stability of the power generation gets more stable.

Furthermore, the rotor 70 has a fixed plate 71 and movable plate 72. The moveable plate 72 is pivoted to the hole 714 of the fixed plate 71 by a screw 75. So that the through hole 713 of the fixed plate 71 can be connected to the movable plate 72 to the outlet water hole 131 of the joint clutch 13. The movable plate 72 can spin emphasis on the screw 75 as the center of rotation with more and further changes to joint clutch 13 of spray gun 10 relative angle to adjust the water spraying elevation, reaching the easy use functions.

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. An LED-illuminated water spraying gun comprising:

a spray gun having a grip handle and a press button on the grip handle; one end of the grip handle having a joint clutch through a rotor, a water hole located at a center portion of the joint clutch so the press button is acted as a switch to control water output;

a cover body having a horn-shaped cover formed with a larger portion and smaller portion, a joint pipe is disposed at the smaller portion to connect to the joint clutch of the spray gun;

a base, one end of which having a first chamber, and the other end having a second chamber; a through hole formed between the first chamber and the second chamber; the base located inside the cover body and secured at the smaller portion to connect to the water hole, and a diversion hole located outside the second chamber and connected to the first chamber; a hook portion disposed at an opening of the first chamber;

an LED light connecting to a power generator, a shaft extending from the power generator, the LED light disposed into the first chamber of the base through the power generator, and the shaft inserting into the through hole and protruding out from the first chamber to connect a set of rotating blades;

a diversion piece having a ring wall that is coupled to the second chamber of the base to cover the rotating blades; a plurality of convex portions protrudingly formed at a center portion of the ring wall, and a rotation hole obliquely formed in each of the convex portions; a water outlet located on the ring wall of the diversion piece to connect with the through hole and diversion hole;

a water cover having a central hole that is connected to a light cover, a plurality of spray holes formed surrounding the outer portion of the central hole, and the water cover covering the larger portion of the cover body; the hook portion of the base configured to secure the water cover, so the LED light is configured to dispose in the light cover, and the spray holes connecting with the diversion hole of the base.

2. The LED-illuminated water spraying gun of claim 1, wherein two stopping pieces are disposed at an outer edge of the joint clutch, and the inner edge of the joint pipe is provided with two protruding stoppers, and the protruding stoppers dodge the stopping pieces to connect to the joint clutch, so the protruding stoppers and the stopping pieces are configured to overlap when rotating the joint pipe.

3. The LED-illuminated water spraying gun of claim 1, wherein a stopper hole is formed at one side of the first chamber, and the stopper hole has a spring and a top block, and when the top block is pushed outward toward the water cover by the spring, the water cover is configured to rotate to control the diversion hole for different water spray holes.

4. The LED-illuminated water spraying gun of claim 1, wherein a gap is formed at the ring wall of the diversion piece, and a positioning column is located at an inner edge of the joint pipe, and the positioning column is configured to plug into the gap of the diversion piece to further position the diversion piece and the joint pipe.

5. The LED-illuminated water spraying gun of claim 1, wherein a magnet rotor is formed inside of the power generator connected to the shaft, and an outer portion of the magnet rotor has a plurality of stator coils, and the LED light is powered by rotating the blade of the magnet rotor.

6. The LED-illuminated water spraying gun of claim 1, wherein the rotor has a fixed plate, a movable plate and a side-cover; the fixed plate that has a first surface and a second surface is integrally formed on the grip handle of the spray gun; the movable plate is configured to spin and coupled to the first surface; and the side-cover covers onto the second surface of the fixed plate.

7. The LED-illuminated water spraying gun of claim 6, wherein the joint clutch is fixed at the movable plate, and a through opening is located at a central portion of the fixed plate, and the through opening is aligned with the water hole of the joint clutch, and a sealing ring is provided between the fixed plate and the movable plate.

8. The LED-illuminated water spraying gun of claim 6, wherein a circular hole is formed at the second surface of the fixed plate, and a screw rod passes through the circular hole to secure on the moveable plate, so that a connection is formed between the fixed plate and the moveable plate.

9. The LED-illuminated water spraying gun of claim 6, wherein the fixed plate has a plurality of recessed grooves at the first surface, a slot is formed at the movable plate, and a spring and a block are disposed in the slot, and the block is disposed against one of the recessed grooves to securely position the fixed plate and movable plate.

* * * * *